US005190221A

United States Patent [19]

Reiter

[11] Patent Number: 5,190,221

[45] Date of Patent: Mar. 2, 1993

[54] ELECTROMAGNETICALLY ACTUATABLE FUEL INJECTION VALVE

[75] Inventor: Ferdinand Reiter, Markgroeningen, Fed. Rep. of Germany

[73] Assignee: Robert Bosch GmbH, Stuttgart, Fed. Rep. of Germany

[21] Appl. No.: 828,897

[22] PCT Filed: Apr. 25, 1991

[86] PCT No.: PCT/DE91/00342

§ 371 Date: Jan. 31, 1992

§ 102(e) Date: Jan. 31, 1992

[87] PCT Pub. No.: WO91/19090

PCT Pub. Date: Dec. 12, 1991

[30] Foreign Application Priority Data

Jun. 7, 1990 [DE] Fed. Rep. of Germany ..... 4018256

[51] Int. Cl.[5] ..... B05B 1/34; F02U 51/08

[52] U.S. Cl. ..... 239/463; 239/585.1

[58] Field of Search ..... 251/129.14; 239/585.1, 239/463, 585.3

[56] References Cited

U.S. PATENT DOCUMENTS 4,524,743 6/1985 McAuliffe et al. ..... 239/585.1 X
4,795,098 1/1989 Kirchner et al. ..... 251/129.14
4,798,329 6/1989 Mesinich ..... 239/585.1 X
4,981,266 1/1991 Aichele et al. ..... 239/585.1 X
5,002,231 3/1991 Reiter et al. ..... 239/585.1

FOREIGN PATENT DOCUMENTS 85359 5/1983 Japan ..... 239/585.1

*Primary Examiner*—Andres Kashnikow
*Assistant Examiner*—Kevin Weldon
*Attorney, Agent, or Firm*—Edwin E. Greigg; Ronald E. Greigg

[57] ABSTRACT

A novel fuel injection valve including an armature which has a through bore, which communicates with a blind bore formed concentrically with a longitudinal valve axis in a ball serving as the valve closing body, and at least one transverse conduit begins at this blind bore and extends to an outer surface of the ball. The fuel reaches the valve seat through the through bore, the blind bore and the at least one transverse conduit. This results in an especially compact embodiment of the fuel injection valve according to the invention. The fuel injection valve is especially well-suited to fuel injection systems of mixture-compressing internal combustion engines with externally supplied ignition.

20 Claims, 2 Drawing Sheets

ELECTROMAGNETICALLY ACTUATABLE FUEL INJECTION VALVE

BACKGROUND OF THE INVENTION

The invention is based on an electromagnetically actuatable fuel injection valve as defined hereinafter. European Patent Disclosure 0 350 885 A2 has already disclosed an electromagnetically actuatable fuel injection valve that has an inner pole, surrounded by a magnet coil, and an armature that is oriented toward the inner pole and is joined to a ball serving as a valve closing body. The ball is slidably supported in a guide bore and cooperates with a fixed valve seat. Since the ball is slidably supported over its entire circumference in the guide bore, the fuel must be guided around the outside circumference of the swirl element having the guide bore. As a result, the known fuel injection valve has a large outside diameter, so that the compactness demanded for fuel injection valves cannot be attained.

ADVANTAGES OF THE INVENTION

The electromagnetically actuatable fuel injection valve according to the invention has an advantage over the prior art of a particularly compact structural form, with an especially small outside diameter, since the fuel can flow directly to the valve seat, through the blind bore and the at least one transverse conduit in the ball acting as a valve closing body.

In addition, the blind bore and the at least one transverse conduit reduce the weight of the ball acting as the valve closing body, which improves the response behavior of the fuel injection valve.

In comparison with known fuel injection valves, the fuel injection valve of the invention has a smaller number of structural parts, making for economical manufacture.

Advantageous further developments of and improvements to the valve disclosed are attainable with the provisions recited hereinafter.

For delivering the fuel to the valve seat, it is advantageous if the at least one transverse conduit discharges into an encompassing recess that is formed in the axial direction between the upstream guide bore, oriented toward the armature, and the downstream valve seat. The recess serves at the same time as a fuel collecting chamber and thus enables reliable injection of the fuel as the ball acting as the valve closing body rises from the fixed valve seat of the fuel injection valve.

It is especially advantageous if the armature and the ball are joined directly to one another, resulting in a very low weight of the valve element comprising the armature and the ball. This makes for faster switching times and less wear on the fuel injection valve and reduces the demands made of the magnetic circuit.

It is advantageous if the at least one transverse conduit discharges at a tangent into the encompassing recess, generating a swirl. As the fuel is injected, for instance into an intake tube of an internal combustion engine, the swirl improves the formation of the fuel-gas mixture.

It is advantageous if a lower pole end, toward the armature, of the inner pole is tightly joined on its circumference to a longitudinal segment of a non-magnetic tubular intermediate part of L-shaped cross section, and if an outwardly pointing flange segment of the intermediate part is tightly joined to an end toward the magnet coil of a nozzle holder. The magnet coil can thus be sealed off from the fuel simply, securely and reliably. This is true even if alcohol fuels are used, which are aggressive with respect to conventional sealing ring materials.

It is advantageous if the longitudinal segment of the intermediate part rests on the lower pole end, having a reduced outside diameter, and the flange segment of the intermediate part rests on a face-end recess of the end of the nozzle holder toward the magnet coil. As a result, the tubular intermediate part requires no additional space, and the fuel injection valve has a compact structure.

It is also advantageous if a guide face serving to guide the armature is formed in a through bore of the intermediate part extending concentrically with the longitudinal valve axis, so that together with the guidance of the ball, particularly good guidance of the valve element comprising at least the armature and the ball is assured. This type of armature guidance is particularly accurate and compact, as well.

For a valve housing that can be manufactured simply and economically and that reliably protects the interior of the valve from external influences, it is advantageous if a stepped tubular valve jacket surrounding the inner pole, the magnet coil and a nozzle holder rests with slight radial initial stress on the inner pole and on the nozzle holder and is joined to the inner pole and nozzle holder by individual spot welds.

To reduce the wear on a face end of the inner pole toward the armature, which is severely strained by the impact of the armature in the opening stroke of the fuel injection valve, it is advantageous if the face end of the inner pole is coated with a ceramic material.

DRAWING

One exemplary embodiment of the invention is shown in simplified form in the drawing and described in further detail in the ensuing description.

FIG. 1 shows a cross sectional view of an exemplary embodiment of a fuel injection valve in accordance with the invention, and FIG. 2 is a section taken along the line II—II of FIG. 1 through the ball acting as the valve closing body.

DESCRIPTION OF THE EXEMPLARY EMBODIMENT

Figure 1:
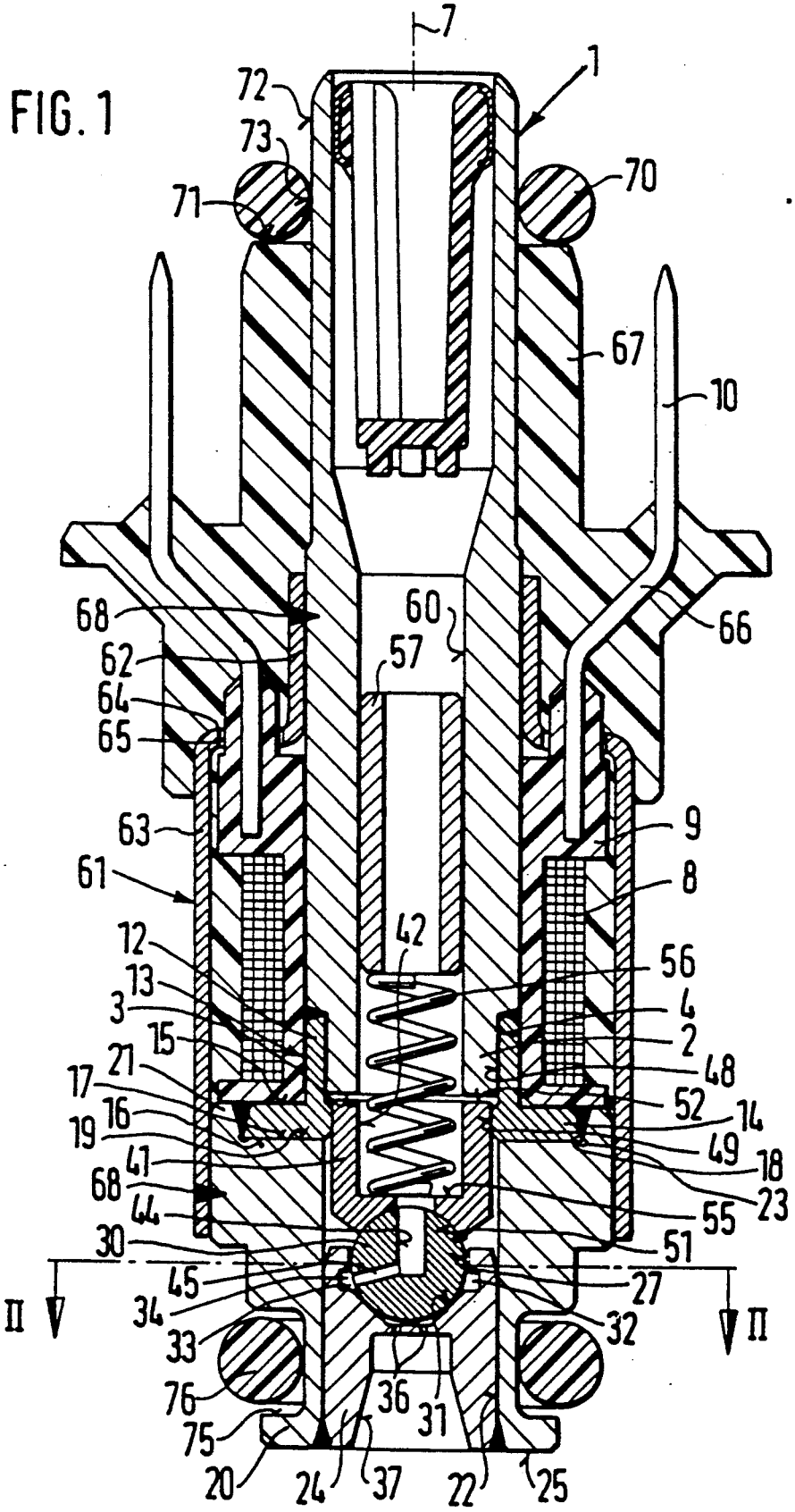

The electromagnetically actuatable fuel injection valve shown by way of example in FIG. 1 for fuel injection systems of mixture-compressing internal combustion engines with externally supplied ignition has a stepped, tubular inner pole 1 of ferromagnetic material, which serves as a fuel inlet neck. On the circumference of its lower pole end 2, extending axially up to a face end 3 of the lower pole end 2, there is a retaining shoulder 4, formed by a reduced diameter. Concentrically with a longitudinal valve axis 7, the inner pole 1 is surrounded by a magnet coil 8 with a winding carrier 9. In the winding carrier 9, electrical contact elements 10, for instance two in number, are jointly injection molded and serve to provide electrical contact for the magnet coil 8.

The circumference of the lower pole end 2 below the retaining shoulder is encompassed by a longitudinal segment 12 of a non-magnetic tubular intermediate part 13 of L-shaped cross section. The longitudinal segment 12 of the intermediate part 13 is tightly joined to the inner pole 1, for instance by welding. The circumference of the inner pole 1 has the same diameter as the circumference of the longitudinal segment 12 of the intermediate part 13, so that the intermediate part 13 requires no additional space in the radial direction.

A radially outwardly pointing flange segment 14 is formed on the intermediate part 13 and rests by its face end 15 toward the magnet coil 8 on the winding carrier 9. By its lower face end 16, the flange segment 14 rests in an end recess 17, which is formed on the end of a nozzle holder 20 oriented toward the magnet coil 8. The flange segment 14 of the intermediate part 13 and the nozzle holder 20 are tightly joined to one another, for instance by welding.

The recess 17 is embodied such that the flange segment 14 of the intermediate part 13 does not protrude axially past the edge 21 of the nozzle holder 20 that defines the recess 17 radially, so that the intermediate part 13 requires no additional space axially, either.

The tubular intermediate part 13 of L-shaped cross section makes a secure and reliable as well as simple sealing off of the magnet coil 8 from the fuel.

If both the inner pole 1 and the nozzle holder 20 are made of a ferromagnetic material, then the non-magnetic intermediate part 13 effects a magnetic separation of the inner pole 1 and nozzle holder 20 and thus effects an improved magnetic performance of the fuel injection valve, which has an especially compact magnetic circuit.

Concentrically with the longitudinal valve axis 7, the nozzle holder 20 has a through bore 22. A nozzle body 24 is thrust into the through bore 22 on the end remote from the magnet coil 8 and is tightly joined, for instance by welding, to one face end 25 of the nozzle holder 20, remote from the recess 17. Toward the magnet coil 8, the nozzle body 24 has a guide bore 27, in which a ball 30 serving as the valve closing body is slidably supported. The guide bore 27 is uninterrupted, so that the ball 30 is particularly well guided with low wear. Downstream of the guide bore 27, there is a fixed valve seat 31 that cooperates with the ball 30. In the axial direction between the guide bore 27 and the valve seat 31, there is an encompassing recess 32 in the nozzle body 24, which for instance takes the form of a rectangular groove 33.

The opening face 34 of the groove 33 is oriented radially toward the longitudinal valve axis 7, for example. Downstream of the valve seat 31 there are injection ports 36, for instance two in number, in the nozzle body 24, which inject the fuel into a preparation bore 37 of the nozzle body 24, which extends concentrically with the longitudinal valve axis 7 and widens in the downstream direction.

The ball 30 serving as the valve closing body is joined directly to a tubular armature 41, which is toward the inner pole 1, for instance by laser welding. This makes for an especially low weight of the valve element comprising the armature 41 and the ball 30, so that faster switching times and less wear of the fuel injection valve are attained and the demands made on the magnetic circuit are reduced. The armature 41 has a stepped through bore 42 extending concentrically with the longitudinal valve axis 7. As a result, the armature 41 and the ball 30 serving as the valve closing body can be welded not only in the region of the circumference of the armature 41 but also in the region of the through bore 42, resulting in improved strength and reliability of the bond between the armature 41 and the ball 30. However, it is also possible for the armature 41 and ball 30 to be joined together by resistance welding.

Figure 2:
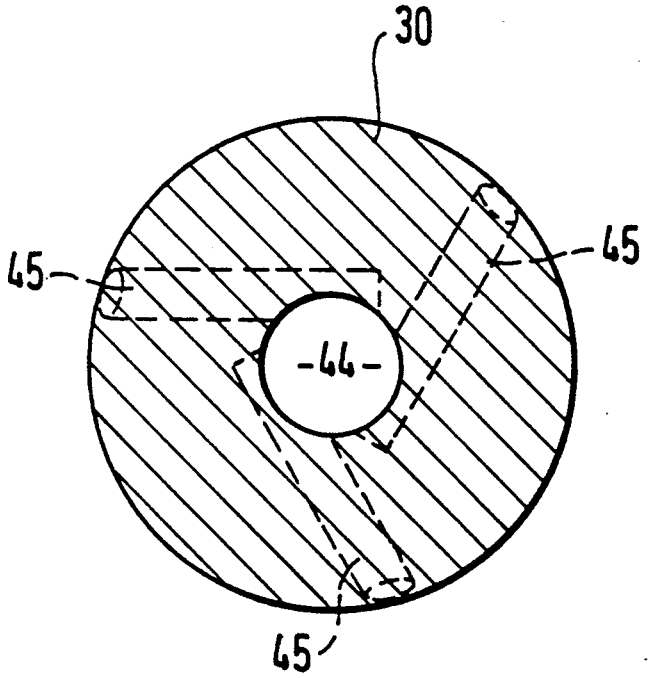

The through bore 42 communicates directly with a blind bore 44, formed in the ball 30 concentrically with the longitudinal valve axis 7. As can also be seen from FIG. 2, which is a section through the ball 30 acting as the valve closing body taken along the line II—II of FIG. 1, transverse conduits 45, for instance three in number, begin at the blind bore 44, leading to the circumference of the ball 30. Both the blind bore 44 and the transverse conduits 45 are for instance formed by erosion in the ball 30. The blind bore 44 and transverse conduits 45 can have any arbitrary cross-sectional shape, for instance round or rectangular. The transverse conduits 45 discharge at a tangent into the encompassing recess 32 of the nozzle body 24, so that upon opening of the fuel injection valve, the fuel is injected, for instance into an engine intake tube, with a swirl through the injection ports 36. The swirl improves the formation of a maximally homogeneous fuel-gas mixture. The encompassing recess 32 acts as a fuel collecting chamber, and the circular-annular embodiment effects the reliable formation of the swirl upon injection of the fuel.

The blind bore 44 serving as a passageway for fuel and the transverse conduits 45 make additional bores or conduits in the nozzle body 24 or magnet armature 41, which would reduce the magnetic cross section and would develop burrs when machined, unnecessary.

In a stepped through bore 48 of the intermediate part 13, embodied concentrically with the longitudinal valve axis 7 toward the valve seat 31, there is an encompassing guide face 49, which has a reduced diameter and serves to guide the armature 41.

If the flange segment 14 of the intermediate part 13 is joined to the nozzle holder 20 by soldering, then an encompassing turned groove 23 is formed, between a parallel segment 18 of the recess 17, extending parallel to the longitudinal valve axis 7, and a transverse segment 19 of the recess 17, extending at right angles to the longitudinal valve axis 7. The turned groove serves to receive the excess solder, so that the already finish-machined guide face 49 of the intermediate part 13 is unaffected.

The armature 41 is produced for instance by extrusion, in the course of which the through bore 42 and a spherical recess 51 of the armature 41 resting on the ball 30 are stamped in final form, so that only the circumference and a face end 52 toward the inner pole 1 of the armature 41 need to be machined further. This substantially reduces the production cost of the armature 41. However, it is also possible to form the armature 41 by metal-cutting machining, such as lathe-turning.

To reduce the wear on the armature 41 in the opening and closing stroke, the circumference of the armature 41 is hard-chrome plated. Both the face end 52 of the armature 1 and the face end 3 of the inner pole 1 are for instance hard-chrome plated, in order to assure both the formation of a remanant air gap in operation of the fuel injection valve between the face end 52 and the face end 3, and good wear protection. However, it is also possible to coat the face end 3 of the inner pole 1 with a ceramic material, so that particularly good wear protection of the face end but also of the face end 52 of the armature 41 is attained.

The axial position of the nozzle body 24 in the through bore 22 of the nozzle holder 20 determines the axial play and thus determines the nominal stroke of the armature 41.

The tubular armature 41, in its stepped through bore 42, on an end remote from the inner pole 1, has a spring shoulder 55, on which one end of a restoring spring 56 is supported. With its other end, the restoring spring 56 rests on an adjusting sleeve 57, which is press-fitted into a through bore 60 of the inner pole 1 that extends concentrically with the longitudinal valve axis 7. The restoring spring 56 thus acts upon the ball 30 in the axial direction and has the effect that the fuel injection valve is kept closed in the unexcited state of the magnet coil 8 and closes the valve without delay upon de-excitation of the magnet coil 8. The depth to which the adjusting sleeve 57 is pressed into the through bore 60 of the inner pole 1 determines the force of the restoring spring 56 with which that spring acts upon the ball 30, for instance in the closed state of the fuel injection valve.

In the axial direction, a stepped tubular valve jacket 61 partially surrounds the inner pole 1, completely surrounds the magnet coil 8, and partially surrounds the nozzle holder 20. The valve jacket 61 is formed by deep drawing of a ferromagnetic sheet, and it has a first cylindrical longitudinal segment 62, which rests on the circumference of the inner pole 1, and a second cylindrical longitudinal segment 63, which rests on the circumference of the nozzle holder 20. Between the first longitudinal segment 62 and the second longitudinal segment 63, which has a larger diameter than the first longitudinal segment 62, there is a radial segment 64 extending for instance at right angles to the longitudinal valve axis 7. The radial segment 64 of the valve jacket 61 has stamped openings 65, for instance two in number, for the ducting therethrough of the electrical contact elements 10. To lend the valve jacket 61 a secure hold on the circumference of the inner pole 1 and of the nozzle holder 20, the valve jacket 61 rests with a slight radial initial tension on the inner pole 1 and on the nozzle holder 20, and it is joined both to the inner pole 1 and the nozzle holder 20 with individual spot welds 68.

The valve jacket 61, made of a ferromagnetic material, also serves to close the electromagnetic circuit comprising the magnet coil 8, inner pole 1, armature 41 and nozzle holder 20.

The electrical contact elements 10, which for instance are two in number, have an offset bend 66 pointing outward from the longitudinal valve axis 7, so that the radial spacing between the electrical contact elements 10 and the longitudinal valve axis 7 is increased. Accordingly, when the fuel injection valve is installed in a supply strip that supplies the engine with fuel, the electrical contacting and fuel delivery can both be effected simultaneously by plugging the valve in axially.

A portion of the inner pole 1 and the valve jacket 61 are axially surrounded by a plastic sheath 67, so that at least the offset bends 66 of the electrical contact elements 10 and the openings 65 of the valve jacket 61 through which the electric contact elements 10 protrude are enclosed by the plastic material. Good dissipation of the heat of the magnet coil 8 produced during operation of the fuel injection valve is attained by filling the space between the valve jacket 61 and the magnet coil 8 with the plastic material, in the course of extruding the fuel injection valve to form the plastic sheath 67.

A sealing ring 70 can be disposed on the circumference of the inner pole 1, remote from the armature 41, and its axial position is limited toward the magnet coil 8 by an end face 71 of the plastic sheath 67. By the embodiment according to the invention of the plastic sheath 67, axial unmolding of the fuel injection valve from the extruding tool used, which is not shown, can be done on the inlet side of the fuel injection valve. Damage to the circumference face 72 of the inner pole 1 in the region of the sealing ring face 73 by the tool parting plane is thereby prevented.

An encompassing groove 75, which for instance has a rectangular cross section, is formed on the circumference of the end of the nozzle holder 20 remote from the magnet coil 8. A sealing ring 76 can be disposed in the groove 75. The sealing rings 70 and 76 provide sealing between the fuel injection valve and a valve holder receiving the fuel injection valve.

The fuel injection valve according to the invention, having the ball 30 acting as a valve closing body, which has both a blind bore 44 and at least one transverse conduit 45 beginning at the blind bore, has a small outside diameter and a compact structure. Economical production is achieved as well. Joining the armature 41 and the ball 30 directly to one another leads to an especially lightweight valve element comprising the armature 41 and the ball 30, so that the switching times are shortened and the wear to the fuel injection valve is lessened.

The foregoing relates to a preferred exemplary embodiment of the invention, it being understood that other variants and embodiments thereof are possible within the spirit and scope of the invention, the latter being defined by the appended claims.

I claim:

1. An electromagnetically actuatable fuel injection valve for fuel injection systems of mixture-compressing internal combustion engines with externally supplied ignition, having an inner pole surrounded by a magnet coil, an armature toward the inner pole that is joined to a ball acting as a valve closing body, said valve closing body is slidably supported in a guide bore in a nozzle holder (20) and cooperates with a fixed valve seat (31), in which the armature (41) has a through bore (42), extending concentrically with a longitudinal valve axis (7), and the ball (30) has a blind bore (44) that communicates with the through bore (42), from said blind bore at least one transverse conduit (45) leads to the circumference of the ball.

2. A valve as defined in claim 1, in which the at least one transverse conduit (45) discharges into an encompassing recess (32), which is formed axially between the upstream guide bore (27), toward the armature (41), and the fixed valve seat (31).

3. A valve as defined by claim 1, in which the armature (41) and the ball (30) are joined directly to one another.

4. A valve as defined by claim 2, in which the armature (41) and the ball (30) are joined directly to one another.

5. A valve as defined by claim 2, in which the at least one transverse conduit (45) discharges at a tangent into the encompassing recess (32).

6. A valve as defined by claim 3, in which the at least one transverse conduit (45) discharges at a tangent into the encompassing recess (32).

7. A valve as defined by claim 4, in which the at least one transverse conduit (45) discharges at a tangent into the encompassing recess (32).

8. A valve as defined by claim 1, in which a lower pole end (2) of the inner pole (1), toward the armature (41), is tightly joined on its circumference to a longitudinal segment (12) of a non-magnetic intermediate part (13) of L-shaped cross section, and that an outwardly pointing flange segment 14 of the intermediate part (13) is joined to an end toward the magnet coil (8) of a nozzle holder (20).

9. A valve as defined by claim 8, in which the longitudinal segment (12) of the intermediate part (13) rests on the lower pole end (2), which has a reduced outside diameter, and the flange segment (14) of the intermediate part (13) rests on a face-end recess (17) of an upper end of the nozzle holder (20) toward the magnet coil (8).

10. A valve as defined by claim 8, in which a guide face (49) serving to guide the armature (41) is formed in a through bore (48) of the intermediate part (13) extending concentrically with the longitudinal valve axis (7).

11. A valve as defined by claim 9, in which a guide face (49) serving to guide the armature (41) is formed in a through bore (48) of the intermediate part (13) extending concentrically with the longitudinal valve axis (7).

12. A valve as defined by claim 1, in which a stepped tubular valve jacket (61) surrounds a portion of the inner pole (1), the magnet coil (8) and a portion of the nozzle holder (20), and rests with a slight radial initial tension on a portion of the inner pole (1) and on a portion of the nozzle holder (20) and is joined to both the inner pole (1) and the nozzle holder (20) with individual spot welds (68).

13. A valve as defined by claim 2, in which a stepped tubular valve jacket (61) surrounds a portion of the inner pole (1), the magnet coil (8) and a portion of the nozzle holder (20), and rests with a slight radial initial tension on a portion of the inner pole (1) and on a portion of the nozzle holder (20) and is joined to both the inner pole (1) and the nozzle holder (20) with individual spot welds (68).

14. A valve as defined by claim 3, in which a stepped tubular valve jacket (61) surrounds a portion of the inner pole (1), the magnet coil (8) and a portion of the nozzle holder (20), and rests with a slight radial initial tension on a portion of the inner pole (1) and on a portion of the nozzle holder (20) and is joined to both the inner pole (1) and the nozzle holder (20) with individual spot welds (68).

15. A valve as defined by claim 5, in which a stepped tubular valve jacket (61) surrounds a portion of the inner pole (1), the magnet coil (8) and a portion of the nozzle holder (20), and rests with a slight radial initial tension on a portion of the inner pole (1) and on a portion of the nozzle holder (20) and is joined to both the inner pole (1) and the nozzle holder (20) with individual spot welds (68).

16. A valve as defined by claim 8, in which a stepped tubular valve jacket (61) surrounds a portion of the inner pole (1), the magnet coil (8) and a portion of the nozzle holder (20), and rests with a slight radial initial tension on a portion of the inner pole (1) and on a portion of the nozzle holder (20) and is joined to both the inner pole (1) and the nozzle holder (20) with individual spot welds (68).

17. A valve as defined by claim 9, in which a stepped tubular valve jacket (61) surrounds a portion of the inner pole (1), the magnet coil (8) and a portion of the nozzle holder (20), and rests with a slight radial initial tension on a portion of the inner pole (1) and on a portion of the nozzle holder (20) and is joined to both the inner pole (1) and the nozzle holder (20) with individual spot welds (68).

18. A valve as defined in claim 10, in which a stepped tubular valve jacket (61) surrounds a portion of the inner pole (1), the magnet coil (8) and a portion of nozzle holder (20), and rests with a slight radial initial tension on a portion of the inner pole (1) and on a portion of the nozzle holder (20) and is joined to both the inner pole (1) and the nozzle holder (20) with individual spot welds (68).

19. A valve as defined by claim 11, in which a stepped tubular valve jacket (61) surrounds a portion of the inner pole (1), the magnet coil (8) and a portion of the nozzle holder (20), and rests with a slight radial initial tension on a portion of the inner pole (1) and on a portion of the nozzle holder (20) and is joined to both the inner pole (1) and the nozzle holder (20) with individual spot welds (68).

20. A valve as defined by claim 1, in which a space (61) of the inner pole (1) toward the armature (41) is coiled with a ceramic material.

* * * * *